US006401952B1

(12) United States Patent
Ming

(10) Patent No.: US 6,401,952 B1
(45) Date of Patent: Jun. 11, 2002

(54) DO-IT-YOURSELF MODULAR ARTICLE-HOLDING CONTAINER

(76) Inventor: Chen Shan Ming, P.O. Box 453, Taichung (TW)

( * ) Notice: Subject to any disclaimer, the term of this patent is extended or adjusted under 35 U.S.C. 154(b) by 0 days.

(21) Appl. No.: 09/749,913

(22) Filed: Dec. 29, 2000

(51) Int. Cl.[7] ..... B63B 67/12; B65D 7/00

(52) U.S. Cl. ..... 220/4.09; 220/4.28; 220/62; 220/297; 220/298

(58) Field of Search ..... 220/4.09, 4.28, 220/62, 297, 298

(56) References Cited

U.S. PATENT DOCUMENTS 672,282 A * 4/1901 Munford ..... 206/83.5
1,500,917 A * 7/1924 Bell ..... 220/4.09
2,087,353 A * 7/1937 Mooney ..... 220/293
5,096,080 A * 3/1992 Penny ..... 220/4.09
5,372,269 A * 12/1994 Sutton et al. ..... 220/4.09
5,678,717 A * 10/1997 Hsu ..... 220/4.28
5,743,422 A * 4/1998 Hale ..... 206/386

* cited by examiner

*Primary Examiner*—Joseph M. Moy

(57) ABSTRACT

A modular container is formed of a casing, a seat ring, a rotary cover, and a base. The casing is provided with a plurality of retaining holes and retaining projections. The seat ring is located in the top of a cylindrical object which is formed by the casing. The base if disposed at the bottom of the cylindrical object. The rotary cover is provided with a plurality of retaining protrusions. The seat ring is provided with a plurality of locating slots. The rotary cover is located by the seat ring such that the retaining protrusions of the rotary cover are located in the locating slots of the seat ring.

6 Claims, 8 Drawing Sheets

DO-IT-YOURSELF MODULAR ARTICLE-HOLDING CONTAINER

BACKGROUND OF THE INVENTION

1. Field of the Invention

The present invention relates generally to a container, and more particularly to a do-it-yourself (DIY) modular container for holding stationery and the like.

2. Description of Related Art

The conventional stationery-holding containers are rather simple and monotonous in design. As a result, their marketability is limited.

BRIEF SUMMARY OF THE INVENTION

The primary objective of the present invention is to provide a DIY modular container comprising a casing, a seat ring, a rotary cover, and a base, which can be arranged in a variety of ways by the consumer.

The objective, features, and functions of the present invention will be more readily understood upon a thoughtful deliberation of the following detailed description of the present invention with reference to the accompanying drawings.

DETAILED DESCRIPTION OF THE INVENTION

Figure 1:
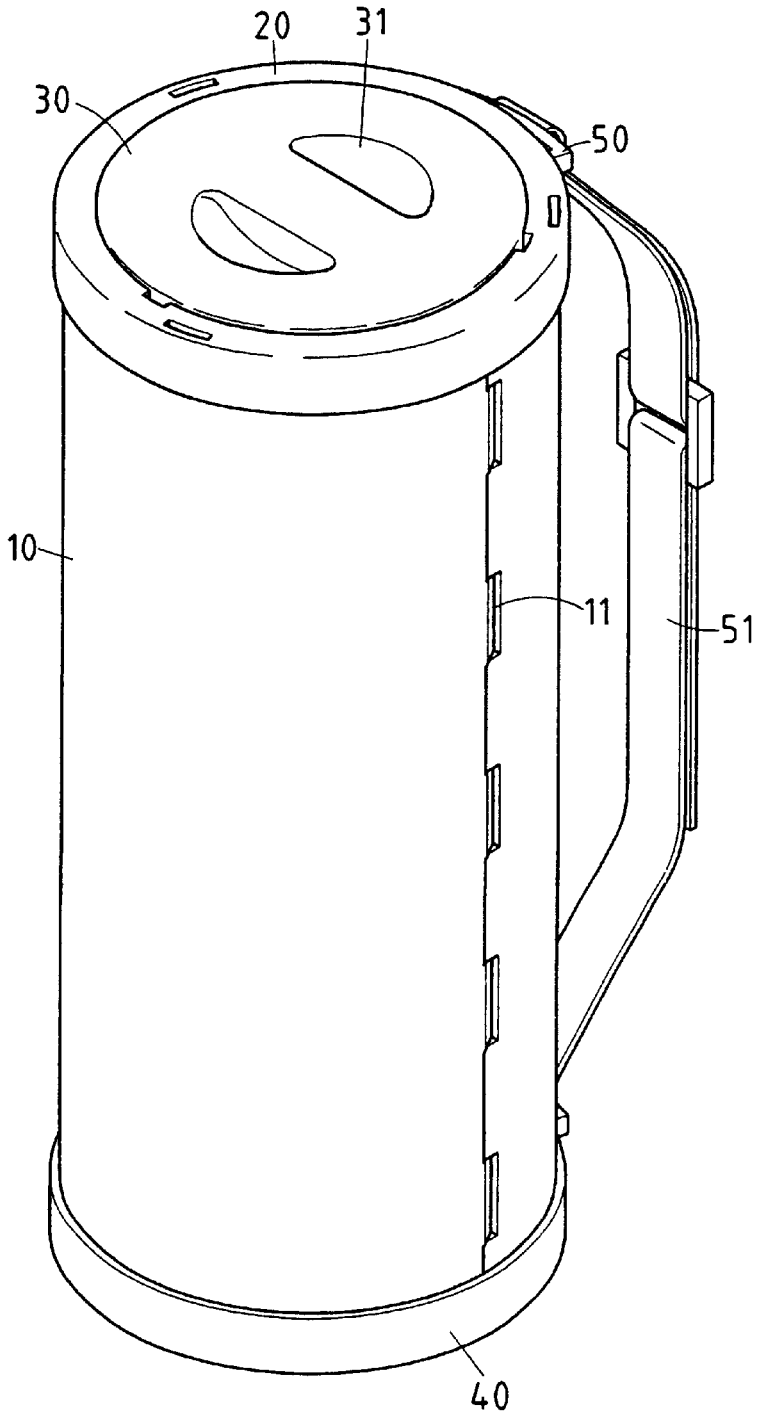
FIG. 1 shows a perspective view of the present invention.
Figure 2:
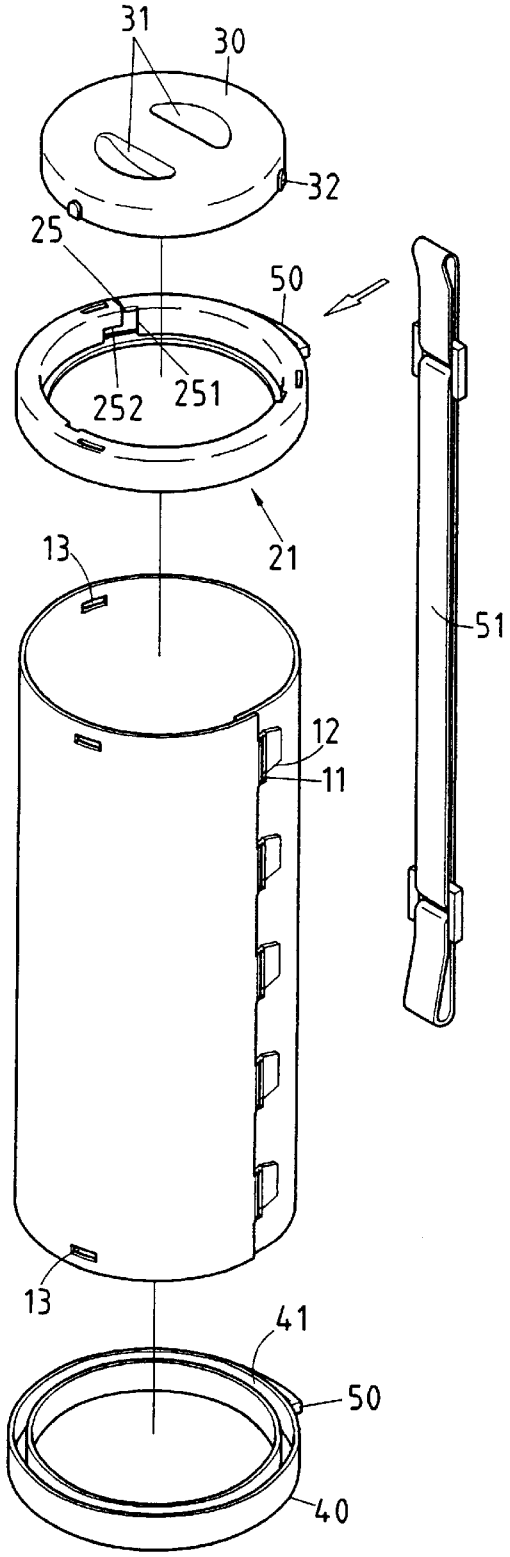
FIG. 2 shows an exploded view of the present invention.
Figure 3:
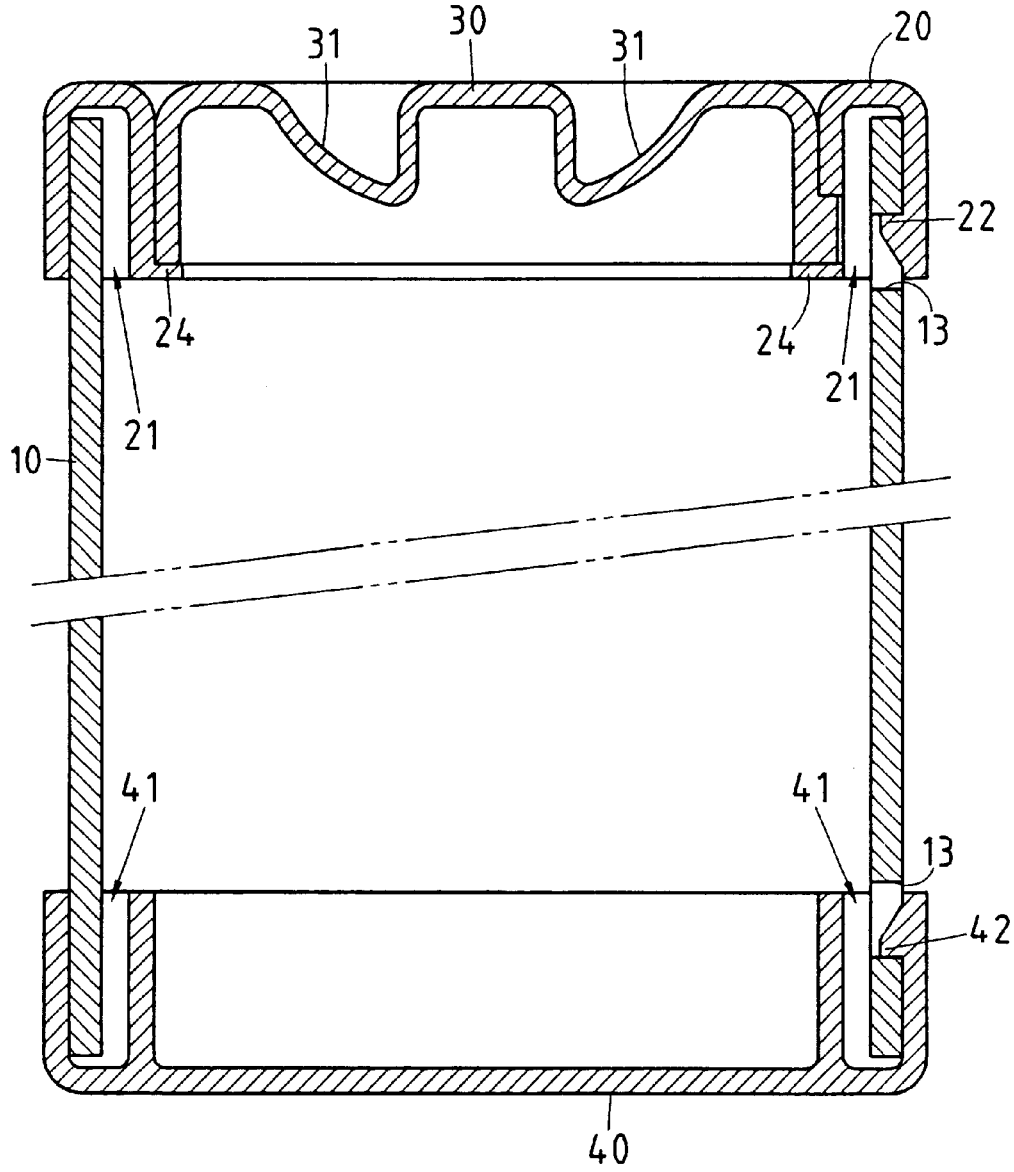
FIG. 3 shows a sectional view of the present invention in combination.
Figure 4:
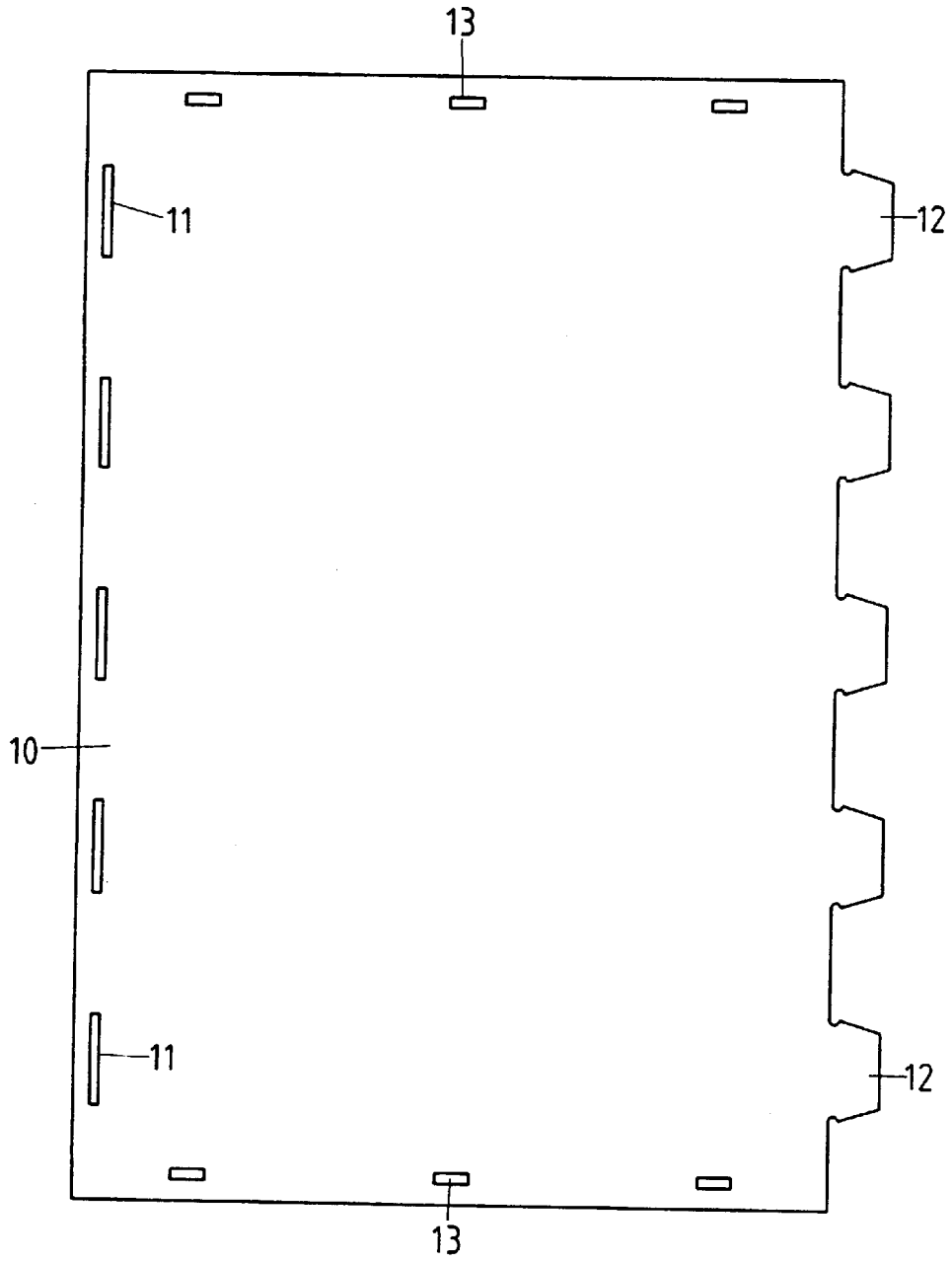
FIG. 4 shows a schematic view of the casing of the present invention that is spread out.
Figure 5:
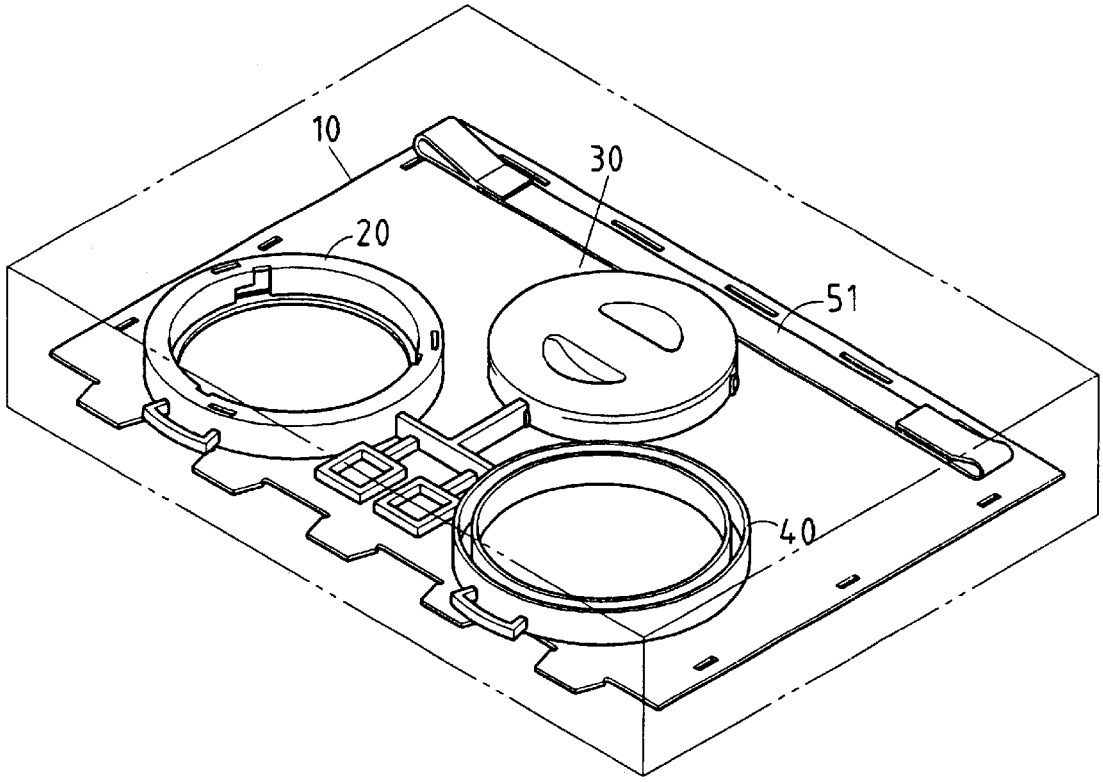
FIG. 5 shows a schematic view of the present invention at work.

As shown in all drawings provided herein, the present invention comprises a casing 10, a seat ring 20, a rotary cover 30, and a base 40.

The casing 10 is provided in one side with a plurality of retaining holes 11, and in other side with a plurality of retaining projections 12 corresponding in location to the retaining holes 11. The casing 10 can be rolled to form a cylindrical object such that the retaining projections 12 are retained in the retaining holes 11. The cylindrical object is provided in the top and the bottom with a plurality of through holes 13.

The seat ring 20 is provided with an annular slot 21 and an inverted hook 22. The seat ring 20 has an inner peripheral edge 23, which is provided with an annular protruded edge 24 and a plurality of locating slots 25.

The rotary cover 30 is provided in the top with a plurality of slotted edges 31, and in the periphery with a plurality of retaining protrusions 32, which are located in the locating slots 25 of the seat ring 20. The rotary cover 30 can be pressed downward and turned such that the rotary cover 30 is located in the seat ring 20, and that the top surface of the rotary cover 30 is level with the top edge of the seat ring 20.

The base 40 is used to seal off the bottom of the cylindrical object. The base 40 has an annular slot 41, which is provided with an inverted hook 42 engageable with the through hole 13.

The seat ring 20 and the base 40 are provided with a lug 50, and a strap 51 which is retained at both ends thereof by the lugs 50. The strap 51 is intended to facilitate the carrying of the cylindrical object.

The locating slots 25 of the seat ring 20 are formed of a vertically-oriented guide slot 251 and a horizontally oriented stop slot 252. The retaining protrusions 32 of the rotary cover 30 are slidably disposed in the guide slot 251 such that the retaining protrusions 32 of the rotary cover 30 are stopped by the stop slot 252 of the locating slots 25 of the seat ring 20.

The slotted edges 31 of the top of the rotary cover 30 have two upright walls and arcuate recesses.

Figure 6:
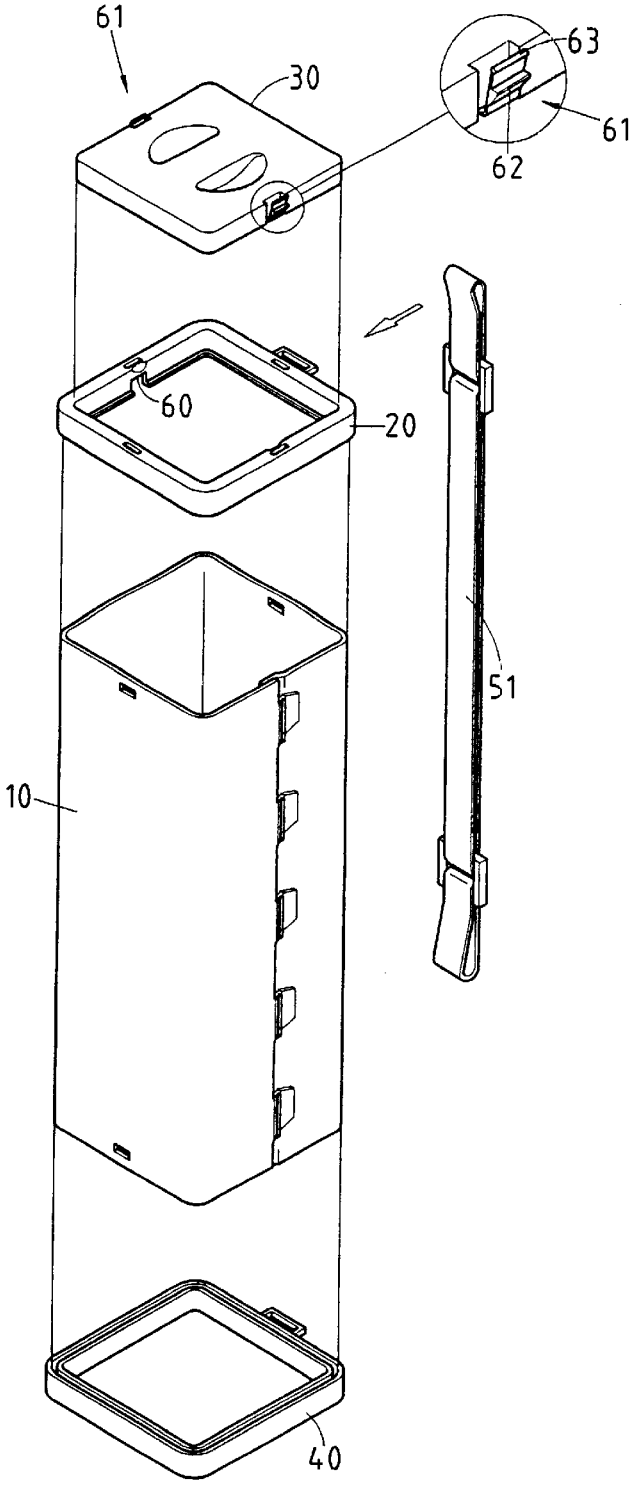
FIG. 6 shows another schematic view of the present invention at work.
Figure 7:
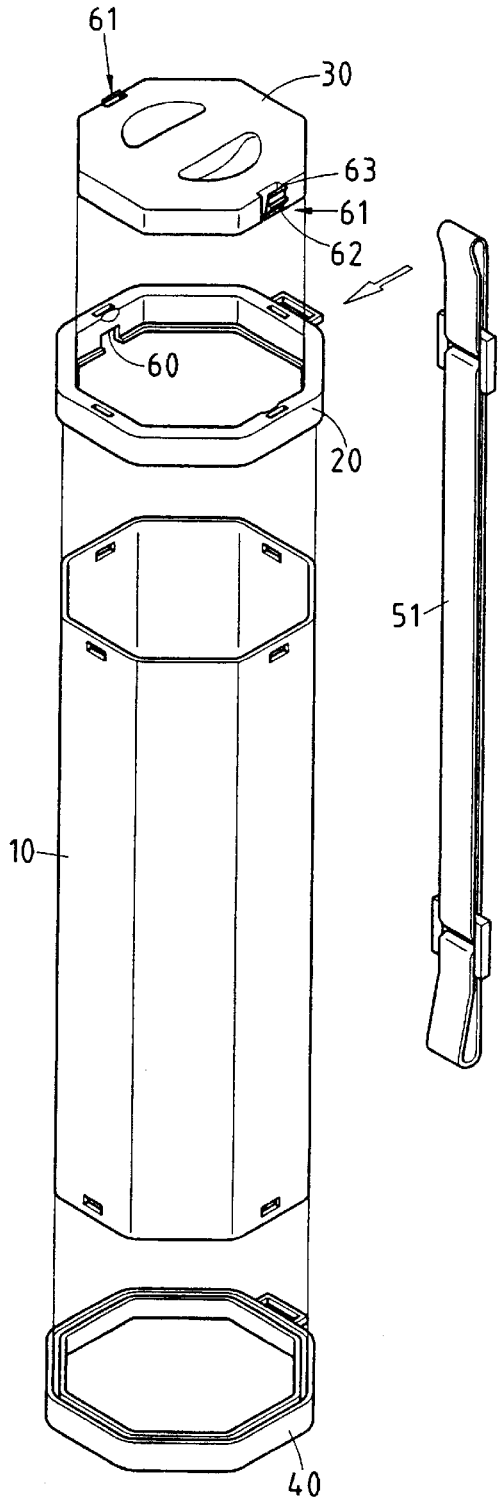
FIG. 7 shows another schematic view of the present invention at work.

The seat ring 20, the base 40, and the rotary cover 30 are round, tetragonal, or polygonal, as shown in FIGS. 6 and 7.

Figure 8:
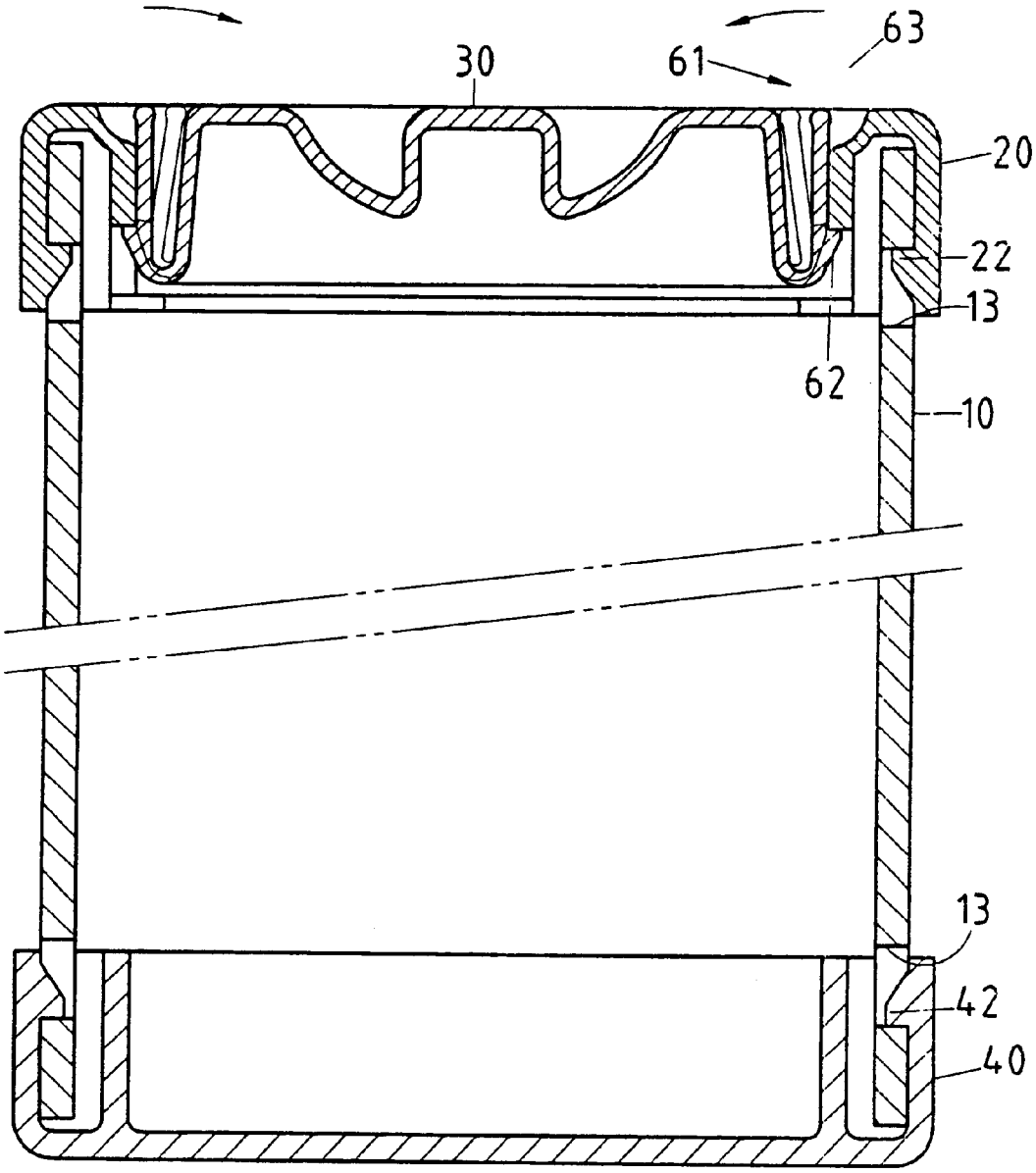
FIG. 8 shows a schematic view of another preferred embodiment of the present invention.

The seat ring 20 and the rotary cover 30 are provided with a plurality of retaining slots 60 and locating buttons 61. The locating buttons 61 are elastic and disposed in the fringe of the rotary cover 30. The locating buttons 61 are provided with a retaining projection 62, which is retained in the retaining slot 60 of the seat ring 20 and is provided with a control portion 63 for forcing the retaining projection 62 to move out of the retaining slot 60, so as to enable the rotary cover 30 to be removed form the seat ring 20, as shown in FIG. 8.

The present invention is versatile in design in that the present invention can be formed as a flat box, which can be shipped or mailed easily. In light of the top of the rotary cover 30 being level with the top edge of the seat ring 20, the rotary cover 30 can be easily removed by finger which is inserted in the slotted edge 31. However, the slotted edge 31 may be sealed off with adhesive tape or label to prevent the removal of the rotary cover 30 by an unauthorized person.

I claim:

1. A modular container comprising:

a casing which is provided in one side with a plurality of retaining holes, and in other side with a plurality of retaining projections corresponding in location to said retaining holes, said casing capable of being rolled to form a cylindrical object such that said retaining projections are retained in said retaining holes, said cylindrical object being provided in the top and the bottom with a plurality of through holes;

a seat ring provided with an annular slot and an inverted hook, said seat ring having an inner peripheral edge which is provided with an annular protruded edge and a plurality of locating slots;

a rotary cover provided in the top with a plurality of slotted edges, and in the periphery with a plurality of retaining protrusions, which are located in the locating slots of said seat ring, said rotary cover capable of being pressed downward and turned in such a manner that said rotary cover is located in said seat ring, and that a top surface of said rotary cover is level with a top edge of said seat ring; and a base for sealing off the bottom of said cylindrical object, said base having an annular slot which is provided with an inverted hook engageable with said through hole of said cylindrical object.

2. The modular container as defined in claim 1, wherein said seat ring and said base are provided with a lug, and a strap which is retained at both ends thereof by said lugs and is intended to facilitate the carrying of said cylindrical object.

3. The modular container as defined in claim 1, wherein said locating slots of said seat ring are formed of a vertically-oriented guide slot and a horizontally-oriented stop slot; wherein said retaining protrusions of said rotary cover are slidably disposed in said guide slot such that said retaining protrusions of said rotary cover are stopped by said stop slot of said locating slots of said seat ring.

4. The modular container as defined in claim 1, wherein said slotted edges of said rotary cover have two upright walls and arcuate recesses.

5. The modular container as defined in claim 1, wherein said seat ring, said base, and said rotary cover are round, tetragonal, or polygonal.

6. The modular container as defined in claim 1, wherein said seat ring and said rotary cover are provided with a plurality of retaining slots and locating buttons, said locating buttons being elastic and disposed in the fringe of said rotary cover, said locating buttons being provided with a retaining projection which is retained in said retaining slot of said seat ring and is provided with a control portion for forcing said retaining projection to move out of said retaining slot, thereby enabling said rotary cover to be removed from said seat ring.

* * * * *